US007557318B2

(12) United States Patent
Osada

(10) Patent No.: US 7,557,318 B2
(45) Date of Patent: Jul. 7, 2009

(54) LIGHT TRANSMITTING OPERATING MEMBER

(75) Inventor: Yoichi Osada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 929 days.

(21) Appl. No.: 11/047,034

(22) Filed: Jan. 31, 2005

(65) Prior Publication Data

US 2005/0168619 A1 Aug. 4, 2005

(30) Foreign Application Priority Data

Feb. 3, 2004 (JP) ..... 2004-026920

(51) Int. Cl.
*H01H 9/02* (2006.01)

(52) U.S. Cl. ..... 200/314; 200/341

(58) Field of Classification Search ..... 200/308–317, 200/341–345, 520, 5 A, 5 B, 17 R, 293; 396/280, 396/281, 439, 297
See application file for complete search history.

(56) References Cited

U.S. PATENT DOCUMENTS 5,718,326 A * 2/1998 Larose et al. ..... 200/314
6,255,610 B1 * 7/2001 Botz et al. ..... 200/315
6,603,083 B2 * 8/2003 Amari et al. ..... 200/5 D
6,803,583 B2 * 10/2004 Taylor ..... 250/397
7,183,511 B2 * 2/2007 Ikeda et al. ..... 200/314
2002/0056614 A1 5/2002 Amari et al.

FOREIGN PATENT DOCUMENTS

CN 2541897 3/2003

* cited by examiner

*Primary Examiner*—Elvin G Enad
*Assistant Examiner*—Marina Fishman
(74) *Attorney, Agent, or Firm*—Cowan, Liebowitz & Latman, P.C.

(57) ABSTRACT

A light transmitting operating member includes a first member having a first transmittance, a second member having a second transmittance greater than the first transmittance, wherein the first member has such a shape that the second member can be inserted into the first member, and the first member includes a compression member for pressing a switch member, and wherein the second member is inserted into the first member.

5 Claims, 6 Drawing Sheets

LIGHT TRANSMITTING OPERATING MEMBER

BACKGROUND OF THE INVENTION

The present invention relates to a light transmitting operating member, and an optical apparatus that includes the same, such as a camera.

RELATED ART

One conventional electronic apparatus arranges a light source on a back surface side etc. of an operating button and introduces the light from the light source to the outside of the apparatus via the operating button for decoration purposes of the apparatus and for guiding the operating method/procedure (see, for example, Japanese Patent Application, Publication No. 2002-216567, paragraph nos. 0014 and 0018 and FIG. 4). The two-color molding is generally used to form plural areas having difference colors and materials on an outer (or operating) surface of the operating button.

However, use of the two-color molding to form plural areas on the outer surface of the operating button has the following problems: For example, in order to coat a light shielding area on the operating button, the masking that prevents the coating material from covering the light transmitting area is formed and then removed, or all the outer surface of the operating button is coated and then coating on the light transmitting area is removed using the laser beam.

It is arduous to remove the masking and coating that are once formed.

BRIEF SUMMARY OF THE INVENTION

Accordingly, it is an exemplary object of the present invention to provide a light transmitting operating member and an electronic apparatus having the same.

A light transmitting operating member according to one aspect of the present invention includes a first member having a first transmittance, a second member having a second transmittance greater than the first transmittance, wherein the first member has such a shape that the second member can be inserted into the first member, and the first member includes a compression member for pressing a switch member, and wherein the second member is inserted into the first member.

An electronic apparatus according to one aspect of the present invention includes a control circuit for control actions, a switch member, a light transmitting operating member that includes a first member having a first transmittance, a second member having a second transmittance greater than the first transmittance, wherein the first member has such a shape that the second member can be inserted into the first member, and the first member includes a compression member for pressing a switch member, and wherein the second member is inserted into the first member, and a light source provided inside the second member, wherein the switch member generates an electric signal when the compression member presses the switch member in accordance with an operation of the light transmitting operating member, wherein a surface of part of the first member and a surface of part of the second member in the light transmitting operating member expose from an opening in a sheath of the electronic apparatus.

Other objects and further features of the present invention will become readily apparent from the following description of the preferred embodiments with reference to the accompanying drawings.

DETAILED DESCRIPTION OF THE PREFERRED EMBODIMENTS

Referring to the accompanying drawings, a description will be given of the preferred embodiment.

First Embodiment

Figure 1:
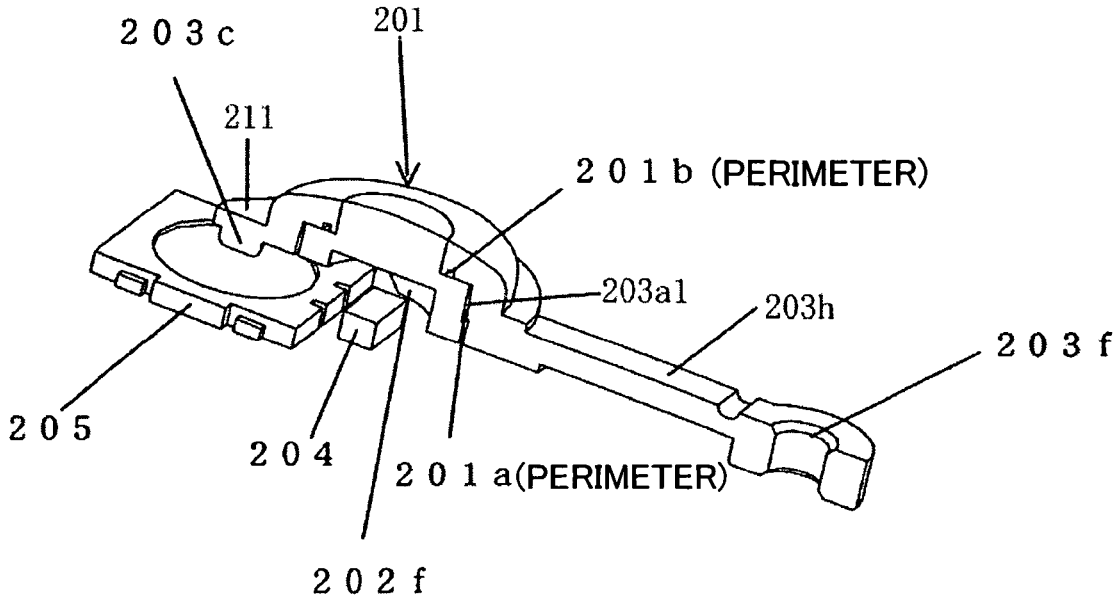
FIG. 1 is a partially sectional and perspective view of an operating button according to a first embodiment of the present invention.
Figure 3:
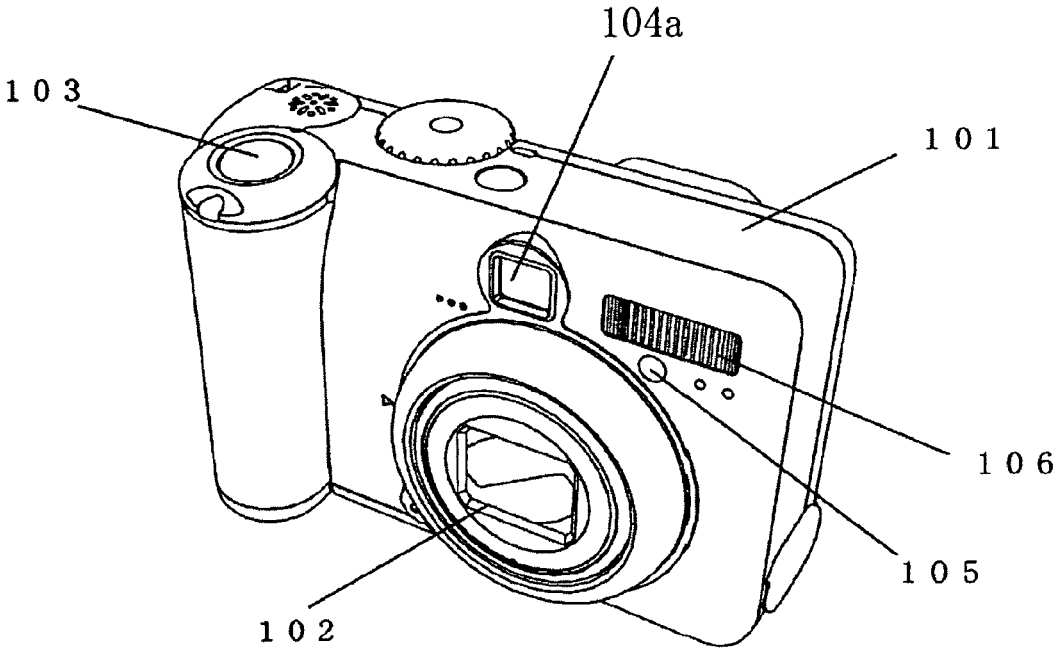
FIG. 3 is a front perspective view of a digital camera having the operating button.

FIG. 3 is a first perspective view of a digital camera (as an electronic apparatus) having an operating button according to a first embodiment of the present invention. In FIG. 1, 101 denotes a camera body that includes various photographing components, such as an image pickup device (such as a CCD and a CMOS image sensor) for converting a optical image into image data through a photoelectric conversion, a low-pass filter, and a control circuit for controlling actions of the entire camera.

102 denotes a lens barrel having a photographing lens, which extends and retreats in the optical-axis direction to change a focal distance of an imaging optical system. 103 denotes a release button that activates a photographing ready action (i.e., a focus adjustment action and a light metering action) when half-pressed, and a photographing action (i.e., recording into a record carrier image data read out by an image pickup device) when fully pressed.

104*a* denotes an object-side window in a finder optical system, which enables a photographer to observe a subject image. 105 denotes a window of a light metering sensor that measures the subject's brightness or the light. The photometric result by the light metering sensor is sent to a control circuit in the camera body 101, and the control circuit operates an exposure value (such as a shutter speed and a stop value). 106 denotes a window of a strobo unit that irradiates the illumination light onto the subject.

Figure 4:
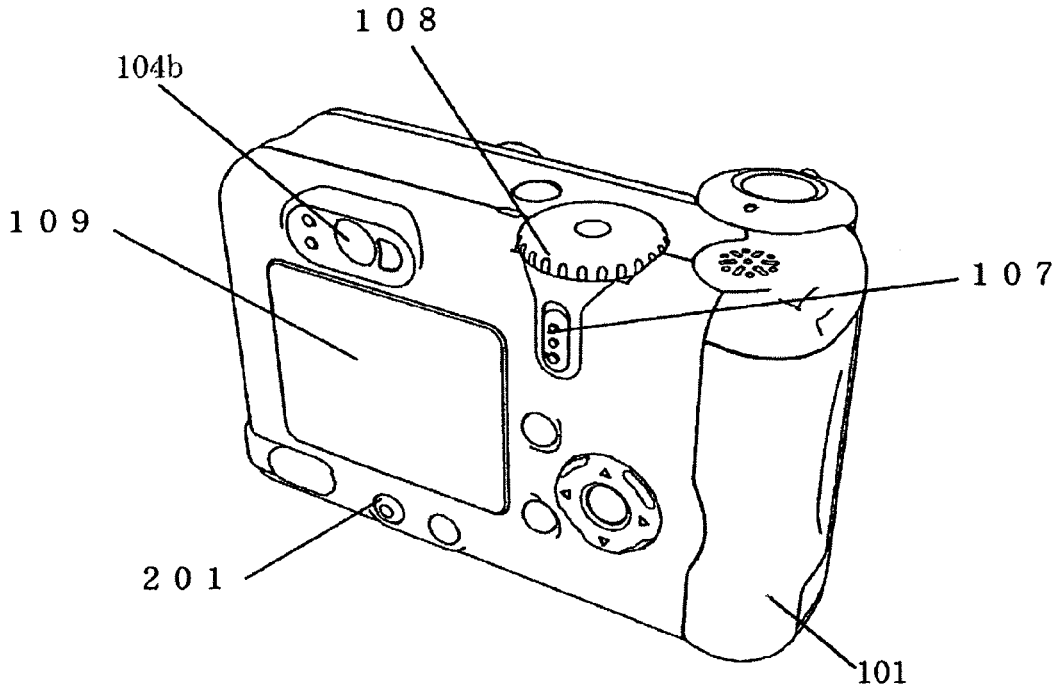
FIG. 4 is a rear perspective view of the digital camera having the operating button.

FIG. 4 shows a rear perspective view of the digital camera according to this embodiment. In FIG. 4, 104*b* denotes an eyepiece-side window in the finder optical system. 107 is a switching lever that switches a mode between a recording mode and a reproducing mode, and is attached to the camera body 101 slidably. When the switching lever 107 is operated to set the recording mode, the subject image is observed via the optical finder 104 or a liquid crystal display ("LCD") unit 109 and photographed by pressing the release button 103.

When the switching lever 107 is operated to set the reproducing mode, image data recorded in the record carrier is displayed on the LCD unit 109.

108 denotes a mode dial, which switches various recording modes (such as an automatic recording mode, a stop priority AE mode, and a shutter speed priority AE mode) 109 denotes a LCD unit, which serves as an electronic view finder in the recording mode and display image data stored in the record carrier in the reproducing mode so as to enable a user to confirm the image. 201 denotes an operating button below the LCD unit 109.

The operating button 201 turns blue when external device, such as a printer (as an output device for outputting the image information on a paper) compatible with the digital camera is connected to the digital camera. An image of the digital camera is transferred to the printer by pressing this operating button 201.

Since the operating button turns blue while the digital camera is being connected to the printer, a user can immediately recognize that the digital camera is connected to the printer. In addition, the user does not press another button by mistake when transferring the image to the printer.

Figure 2:
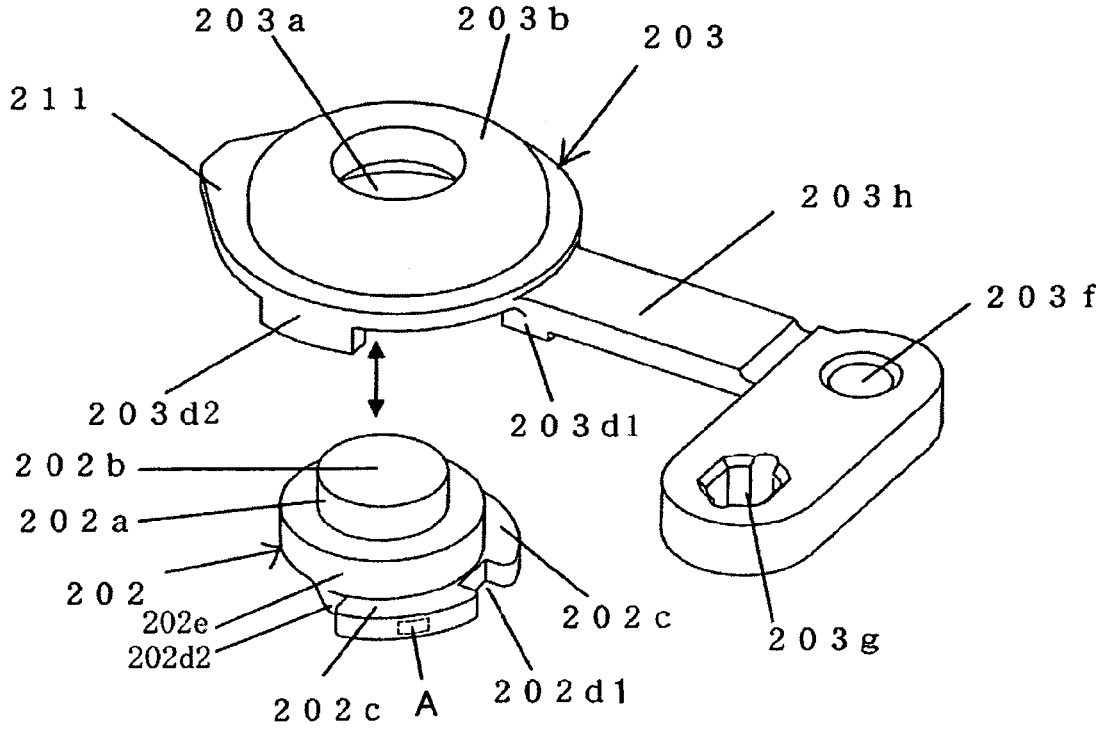
FIG. 2 is an exploded perspective view of the operating button according to the first embodiment.

Primarily referring to FIGS. 1 and 2, a description will now be given of a structure of the operating button 201. The operating button 201 has a light transmitting inner button 202 (as a second member), and a light shielding outer button 203 (as a first member) having a transmittance of approximately zero.

The inner button 202 and outer button 203 are integrated into one member. The inner button 202 (or its protrusion 202*a*) is inserted into an insertion hole 203*a* in the outer button 203, and the inner button 202 and the outer button 203 are bonded together by the adhesive agent.

The adhesive agent that bonds the inner button 202 and the outer button 203 together is inserted into a space 201*a* defined by an outer circumference surface 202*e* on the inner button 202 and an inner circumference surface 203*a*1 of the insertion hole 203*a* in the outer button 203 (which opposes to the outer circumference surface 202*e*).

For tight bonding between the inner button 202 and the outer button 203, the adhesive agent must be filled in the space 201*a* that extends in the circumferential directions of the buttons 202 and 203. Therefore, this embodiment inclines or tapers the inner circumference surface 203*a*1 of the outer button 203, which increases its diameter from the inner side to the outer side (opposing to the outer surface of the operating button) of the outer button 203. In other words, the tapered surface 203*a*1 increases an interval between the inner circumference surface 203*a*1 and the outer circumference surface 202*e* from the inside to the outside of the operating button 201. This configuration makes the space 201*a* is wide at the insertion hole side for the adhesive agent and narrow in the interior side for the adhesive agent. As a result, the adhesive agent can be flowed on the inner circumference surface 203*a*1 and the outer circumference surface 202*e* entirely, and tightly bonds the inner button 202 and the outer button 203 together.

While this embodiment provides only the outer button 203 with the tapered surface 203*a*1, the outer circumference surface 202*e* of the inner button 202 may be provided with a tapered surface singularly or in combination with the tapered surface 203*a*1 because it is sufficient that the space 201*a*'s shape is wide at the insertion hole for the adhesive agent and narrow in the interior for the adhesive agent.

In using the adhesive agent, it is necessary that the adhesive agent does not flow out through the contact portions between the inner button 202 and the outer button 203 to the outer surface of the operating button 201 (or outer surfaces 202*b* and 203*b* of the buttons 202 and 203).

Therefore, this embodiment forms, as shown in FIG. 1, an overflow resistant groove 201*b* that extends in an operating direction (or squeezing direction) of the operating button 201, on a surface orthogonal to the operating direction in the insertion hole 203*a*. The outflow of the adhesive agent to the outer surface is prevented by allowing the extra adhesive agent to flow in the overflow resistant groove 201*b*. The overflow resistant groove 201*b* is formed in the entire circumferential direction of the insertion hole 203*a*.

The overflow resistant groove 201*b* may be provided only partially on the insertion hole 203*a* in the circumferential direction. Alternatively, a groove corresponding to the overflow resistant groove 201*b* may be provided only in the inner button 202 singularly or in combination with the overflow resistant groove 201*b*.

While this embodiment integrates the inner button 202 with the outer button 203 using the adhesive agent, an engagement part may be provided to each of the inner button 202 and the outer button 203 for the integration between them through the engagement of these engagement parts. The inner button 202 and the outer button 203 may be fused or integrated by other means.

This embodiment flattens the outer surface 202*b* of the inner button 202 and the outer surface 203*b* of the outer button 203 by defining one joint surface between the inner button 202 and the outer button 203 as a designed reference surface and setting the size this designed reference surface to the outer surfaces 203*b* and 202*b*.

This configuration can minimize problems that the only the inner button 202 (or its protrusion 202*a*) projects from the outer surface of the operating button 201 and only the inner button 202 (or outer surface 202*b*) retreats from the outer surface 203*a* of the outer button 203. Therefore, the outer surface of the operating button 201 looks well with a sense of unity similar to the two-color molding.

This embodiment forms the operating button 201 whose operating surface is partially coated by previously coating the outer surface 203*b* of the outer button, and by attaching the inner button 202 to the coated outer button 203. This method can save arduous tasks, unlike the two-color molding, such as masking an area that does not require coating and removing the mask after the coating, or peeling off the unnecessary coating portion using the laser beam. Saving this arduous task makes the manufacturing process of the operating button simple and inexpensive.

The outer button 203 has first and second reference holes 203*f* and 203*g* through which bosses that protrude from a sheath cover penetrates, and the outer button 203 is fixed to the sheath cover of the camera body 101 via the bosses. Here, the first reference hole 203*f* positions the outer button 203 relative to the sheath cover. The second reference hole 203*g* determines a rotational angle, and enables the outer button 203 to be attached to the sheath cover at a predetermined position.

FIG. 1 arranges a light emitting diode ("LED") 204 as a light source on the rear surface of the operating button 201 (opposing to its outer surface). The LED 204 is arranged approximately below the center of the outer surface of the operating button 201. A boss 203*c* (as a compression member) that contacts a tact switch 205 is formed on a flange portion 211 that extend more outwardly than the outer surface 203*b* in the radial direction. This LED turns blue when an external device, such as a printer, is connected to this digital camera via a cable, etc.

The LED 204 and the boss 203*c* provided outside the inner button 202 prevent the boss 203*c* from shielding the light from the LED 204 and from causing the uneven brightness, and spread the light from the LED 204 over the entire inner button 202. This configuration maintains the sufficient light intensity, and efficiently emits the light from the outer surface 202*b* of the inner button 202 to the outside.

Conceivably, the light tint or concentration of the inner button 202 makes the LED 204 and wiring board in the camera body 101 visible from the outside via the inner button

202. The enhanced diffusing power of the inner button 202 would eliminate problem that the LED 204 and wiring board in the camera body 101 etc. are visible from the outside.

When the inner button 202 has such a dark color that none of the wiring board etc. are visible from the outside, the light intensity of the light emitted from the operating button 201 to the outside might reduce. However, this embodiment arranges the LED 204 approximately below the center of the outer surface of the operating button 201, maximizes the light emitted from the LED 204, and maintains the sufficient light intensity of the light emitted from the LED 204.

It is possible to prevent the light intensity loss in the operating button 201 and to increase the brightness by planishing a surface of the insertion hole 203*a* of the outer button 203, coating the surface with a silver material having the high reflectance, and plating the surface, etc. The light intensity of the light emitted from the outer surface of the operating button 201 to the outside increases by the reduced light intensity loss.

An application of the same process to the surface of the insertion hole 203*a* and the outer surface 203*b* would simplify the processing to the operating button 201 (or outer button 203).

Changes of the luminescent color of the LED 204 and the current value that flows the LED 204 and use of different inner button 202 would provide various types of brightness and tints.

In this embodiment, when the user presses the operating button 201, the operating button 201 deforms at a hinge 203*h* of the outer button 203 and the boss 203*c* provided on the rear surface of the outer button 203 contacts the tact switch 205 mounted on the wiring board (not shown). Thereby, the tact switch 205 turns on, and this signal is sent to the control circuit in the camera body 101.

The rear surface of the inner button 202 (or a surface opposing to the outer surface 202*b*) has a concave 202*f*. Therefore, even when the operating button 201 is pressed, the inner button 202 does not contact the LED 204. In other words, the concave 202*f* provides an arrangement close to the operating button 201 (or the inner button 202), reduces the arrangement space around the operating button 201, and miniaturizes the camera.

When the user stops pressing the operating button 201, the operating button 201 promptly returns to the predetermined position (a pre-pressed position) due to the reaction by the hinge 203*h* of the outer button 203. At this time, when the boss 203*c* separates from the tact switch 205, the tact switch 205 turns off. Until the operating button 201 is pressed again, the tact switch 205 remains at the off state.

Since the operating button 205 has two components, i.e., the inner button 202 and the outer button 203, an excessive outer force applied to the operating button 201 might possibly disengage the inner button 202 from the outer button 203: Since the outer button 203 is fixed onto the sheath cover of the camera via the reference holes 203*f* and 203*g* and the inner button 202 is fixed onto the outer button 203 via the adhesive agent, an application of the external force to the inner button 202 could offset a joint position between the inner button 202 and the outer button 203.

Figure 5:
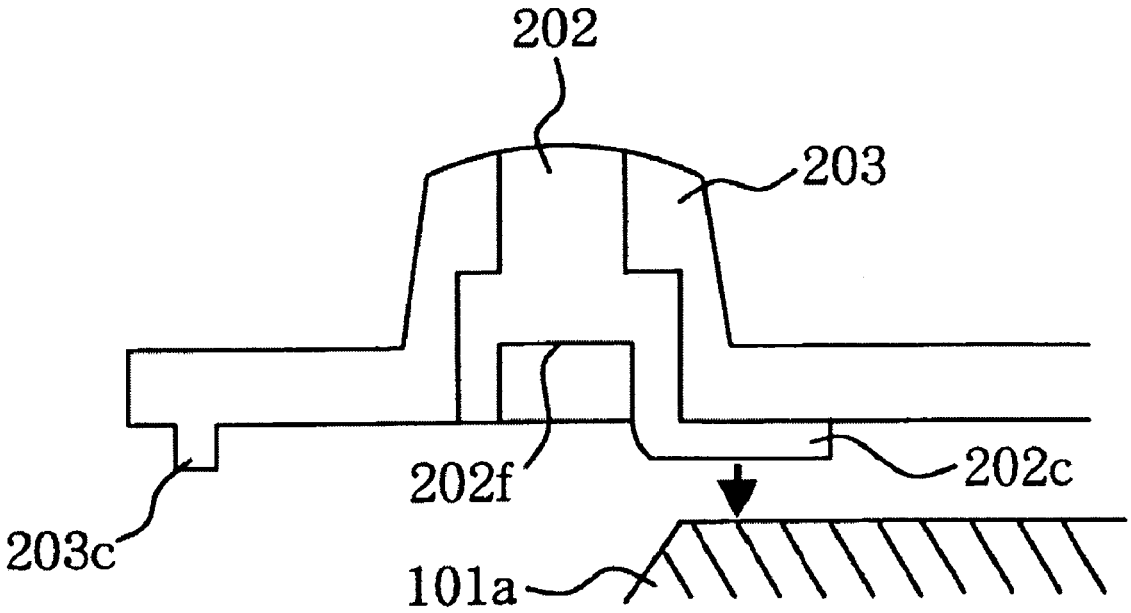
FIG. 5 is a sectional view of the operating button according to the first embodiment.

Accordingly, this embodiment forms a pair of legs 202*c* on the outer circumference surface of the inner button 202, each of which extends to the outside of the inner button 202 in a radial direction. The leg 202*c* (or the elongated part) contacts a chassis 101*a* provided in the camera body 101 (see FIG. 5). This configuration reduces the shearing stress at the joint part between the inner button 202 and the outer button 203, preventing an offset of the inner button 202 relative to the outer button 203.

In order to prevent the inner button 202 and the outer button 203 from being connected to each other at an offset state from the above predetermined phase, the inner button 202 and the outer button 203 should be incorporated while their phases are being matched. This embodiment engages legs 203*d*1 and 203*d*2 formed on the outer button 203 with positioners 202*d*1 and 202*d*2 formed on the inner button 202, and incorporates the inner button 202 with the outer button 203 at the above predetermined phase.

A description will now be given of the gate position in molding the inner button 202. As described above, the inner button 202 is made of a light transmitting material (such as resin), and is formed by flowing the resin into the specific mold from the gate. This embodiment provides the molding gate position on the outer surface of the leg 202*c*, as shown by a broken line A in FIG. 2, for the following reasons.

The molding gate position provided on the outer surface 202*b* of the inner button 202 causes the flashes etc. to be located on the outer surface 202*b*, which occur when the gate is removed. In this case, the flashes etc. causes the unevenness of the light emitted to the outside from the outer surface 202*b* and makes the outer surface of the operating button 201 look poor.

The molding gate position provided at the contact part between the intermediate position 202 and the insertion hole 203*a* in the outer button makes unstable the contact between the inner button 202 and the outer button 203 due to the flashes etc. that can occur during the gate process, and lowers the joint force between the inner button 202 and the outer button 203. Therefore, this embodiment provides the molding gate position on the outer surface of the leg 202*c*, which is a part that is located other than the outer surface 202*b* of the inner button 202 and other than the part that contacts the insertion hole 203*c*.

The inner button 202 and the outer button 203 can be integrated with each other before the gate processing of the inner button 202 by providing the gate position on the outer circumference surface of the leg 202*c* and forming a runner at a position that does not interferes with the outer button 203 when the outer button 203 is incorporated with the inner button 202. Use of the runner that is more easily handled than the inner button 202 and the outer button 203 to integrate the inner button 202 with the outer button 203 facilitates the assembly of the operating button 201.

Figure 6:
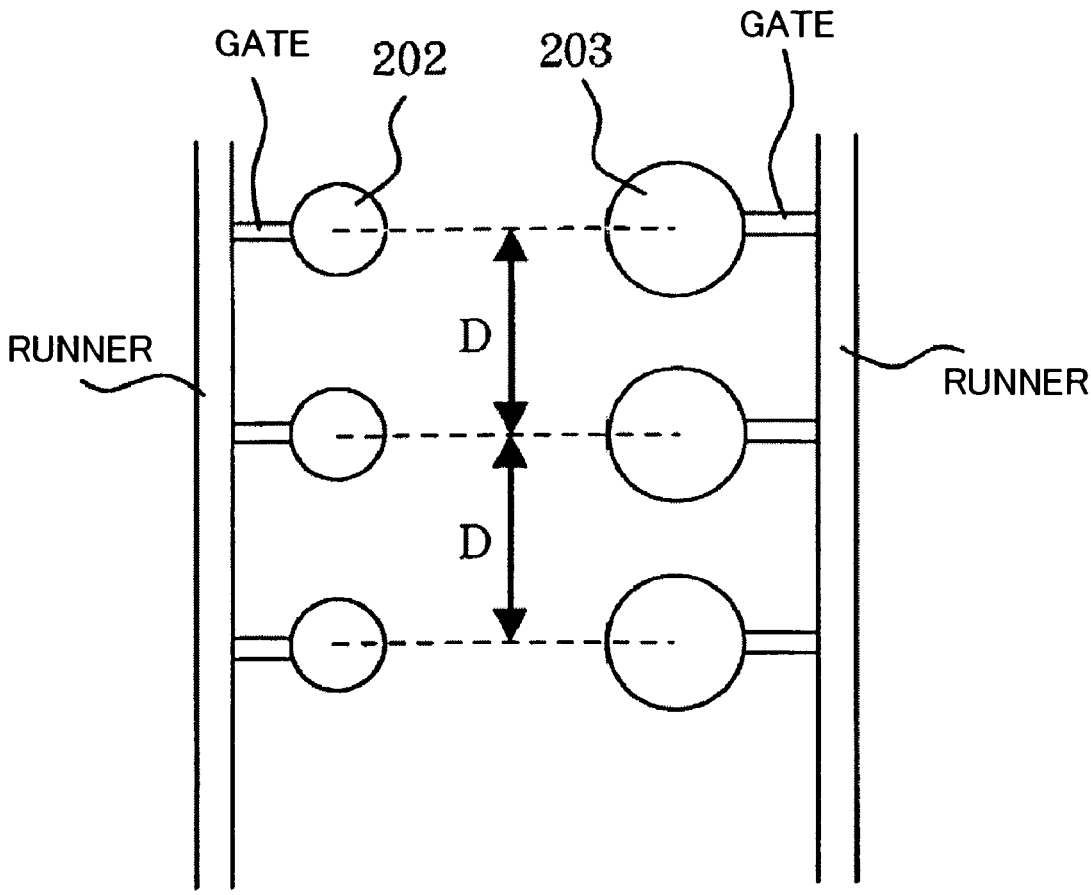
FIG. 6 is an assembly step of intermediate and outer buttons.

Simultaneous molding of plural inner buttons 202 facilitates an integration between the inner button 202 and the outer button 203 using the runner. When the inner button 202 and the outer button 203 have the corresponding intervals (D) can provide simultaneous molding of plural inner buttons 202 and plural outer buttons 203 as shown in FIG. 6 before the gate processing to the inner button 202 and the outer button 203, facilitating the assembly of the operating button 201.

A description will now be given of a variation of the first embodiment.

While the first embodiment arranges the light transmitting inner button 202 at the center of the operating button 201 and the light shielding outer button 203 (having the transmittance of approximately zero) around the inner button 202, the present invention is not limited to the configuration of the first embodiment.

For example, the material for the inner button 202 may be replaced with the material for the outer button 203. In other words, the inner button 202 shields the light from the LED 204 while the outer button 203 transmits the light. The inner button 202 and the outer button 203 transmit the light while their transmittances may differ from each other. For example, the transmittance of the inner button 202 may be higher or lower than the transmittance of the outer button 203.

The above variation can exhibit similar effects to those of the first embodiment.

While the above embodiment provides the operating button to the digital camera, the present invention is applicable, for example, to a portable game machine, remote controller, portable audio equipment, etc.

This application claims foreign priority benefits based on Japanese Patent Application No. 2004-026920, filed on Feb. 3, 2004, which is hereby incorporated by reference herein in its entirety as if fully set forth herein.

What is claimed is:

1. A light transmitting operating member comprising:

a first member having a first transmittance; and a second member having a second transmittance greater than the first transmittance, wherein the first member is provided with an insertion hole into which the second member is inserted, and the second member is provided with an outer circumference surface which faces an inner circumference surface of the insertion hole in a state where the second member is inserted into the insertion hole, wherein at least one of the inner circumference surface of the insertion hole and the outer circumference surface of the second member is provided with a tapered surface which decreases a gap between the inner circumference surface and the outer circumference surface as approaching an exterior surface of the operating member, and wherein at least one of the inner circumference surface of the insertion hole and the outer circumference surface of the second member is provided with a groove at a position closer to the exterior surface of the operating member than the tapered surface, the groove preventing an adhesive agent flowing into between the inner circumference surface and the outer circumference surface from flowing out on the exterior surface of the operating member.

2. A light transmitting operating member according to claim 1, wherein an exterior surface of the first member is coated with a coating material prior to insertion of the second member into the insertion hole.

3. A light transmitting operating member according to claim 2, wherein the inner circumference surface of the insertion hole is coated with a coating material prior to insertion of the second member into the insertion hole.

4. A light transmitting operating member according to claim 1, wherein the inner circumference surface of the insertion hole and the outer circumference surface of the second member include surfaces orthogonal to an operation direction of the operating member, and wherein the groove is formed on at least one of the surfaces orthogonal to the operation direction.

5. An electronic apparatus comprising:

an electronic circuit;

an operating member; and a switch member which generates an electric signal that is input to the electronic circuit in response to an operation of the operating member;

wherein the operating member comprises:

a first member having a first transmittance;

a second member having a second transmittance greater than the first transmittance; and a light source provided inside the second member;

wherein the first member is provided with an insertion hole into which the second member is inserted, and the second member is provided with an outer circumference surface which faces an inner circumference surface of the insertion hole in a state where the second member is inserted into the insertion hole, wherein at least one of the inner circumference surface of the insertion hole and the outer circumference surface of the second member is provided with a tapered surface which decreases a gap between the inner circumference surface and the outer circumference surface as approaching an exterior surface of the operating member, and wherein at least one of the inner circumference surface of the insertion hole and the outer circumference surface of the second member is provided with a groove at a position closer to the exterior surface of the operating member than the tapered surface, the groove preventing an adhesive agent flowing into between the inner circumference surface and the outer circumference surface from flowing out on the exterior surface of the operating member.

* * * * *